US005301740A

United States Patent [19]

Erana

[11] Patent Number: 5,301,740

[45] Date of Patent: Apr. 12, 1994

[54] AIR IMPACT SANDBOX MOULDING MACHINE WITH A BLOWING HEAD

[76] Inventor: Augustin A. Erana, Zorrostea 4, Poligano Industrial Ali Gobeo, 01010- Vitoria (Alava), Spain

[21] Appl. No.: 967,698

[22] Filed: Oct. 27, 1992

[30] Foreign Application Priority Data

Oct. 30, 1991 [ES] Spain ..... 9102403

[51] Int. Cl.[5] ..... B22C 15/28

[52] U.S. Cl. ..... 164/195; 164/169; 164/207

[58] Field of Search ..... 164/195, 169, 207, 37, 164/38

[56] References Cited

U.S. PATENT DOCUMENTS 4,230,172 10/1980 Uzaki et al. ..... 164/195 X
4,750,540 6/1988 Boenisch ..... 164/195 X
5,161,596 11/1992 Fischer et al. ..... 164/195 X

*Primary Examiner*—J. Reed Batten, Jr.
*Attorney, Agent, or Firm*—Helfgott & Karas

[57] ABSTRACT

A moulding machine with a blowing head includes a hollow rammer within which is provided a valve which receives blast air from a drum and which by telescopic conduits plays inside guide-columns in a fixed framework. The rammer is fixed through a flange to a metal plate provided with holes for passage therethrough of blowing air. The metal plate plays tightly inside a subframe which is rigidly connected to a framework fixed to the machine. Another frame, associated with a moulding box, is tightly coupled with the box when a table carrying a moulding plate rises so that after blowing air when the valve opens or after compacting by blowing, the rammer travels down and hence also the metal plate which performs a mechanical compacting of the sand mass.

1 Claim, 1 Drawing Sheet

AIR IMPACT SANDBOX MOULDING MACHINE WITH A BLOWING HEAD

BACKGROUND OF THE INVENTION

The present invention relates to a blowing head specifically, designed for air impact sandbox moulding machines. In such machines, the box is first filled with sand and the same is then compacted in to consecutive operations, in one of which air is blown onto the sand mass, and in another of which a mechanical compacting takes place, the two operations being carried out successively and immediately, using the same head, which acts as a blowing means and as a mechanical compacting means.

The applicant himself is the holder of Spanish patent of invention 8703409, for a shooting mechanism for coreshooters, wherein the rammer, designed to be coupled to the sand cartridge, is hollow and houses therein a pop valve, that is triggered due to the pressure existing in a drum, which pressure arrives at the valve through the actual guide-columns for alternating displacement of the rammer in coupling and uncoupling to and from the sand cartridge, the pop valve being driven by the actual pressure in the drum, such that the pressure normally arrives at the packing piston through two chambers that are set against each other, a chamber through which blowing air passes on its way towards the cartridge and an auxiliary chamber established at the rear of the packing piston and through which the piston is held closed, while the pressure entering the auxiliary chamber from the drum is not discontinued, which comes about precisely when the shooting takes place.

Furthermore, and within the field of air impact sandbox moulding machines, subject hereof, the applicant himself is also the holder of Spanish patent of invention 8901201, regarding a number of improvements to this kind of machines, which improvements comprise placing a sandsupplying hopper at the mouth of the machine, under the hatch supplying batched sand, a mo-&or, duly protected against sand discharges and making up the element driving a number of lower blades or vanes that spread out and level the sand within the compacting chamber, the assembly being enclosed by a release valve, that is disposed annularly outside the hopper and provided with an annular stopper, such that after the sand is batched, the motor causes the sand to be spread out and levelled within the box and its respective frame whereupon pneumatic compacting takes place by opening the annular stopper and suddenly releasing compressed air onto the compacting chamber, specifically onto the upper base of the mass of the sand-binder mixture.

However, in machines such as that disclosed in Spanish patent of invention 8901201 and in any other air impact sandbox moulding machines, the sand mass not only fills the sandbox, but a sizeable part of the upper frame, and given that the box must subsequently be levelled, all the sand housed in the frame will be wasted.

To overcome this problem, in some machines the box and the frame move to a station where additional mechanical compacting follows, either by means of manifold pneumatic or hydraulic rammers or by means of a single rammer, thereby to improve the compacting of the sand mould and at the same cut down on the waste.

SUMMARY OF THE INVENTION

The blowing head for air impact sandbox moulding machines, subject of the instant application has been designed and structured in order that it may carry out the above-mentioned two compacting stages consecutively, viz. a first air impact compacting stage and a second mechanical compacting stage.

More specifically and in order to achieve the above, the head comprises a shooting mechanism initially provided for a coreshooting machine, duly modified to be used in an air impact sandbox moulding machine.

In particular, the machine comprises a rammer, a flange for the rammer, permanently fitted with a metal plate, provided with holes for the passage of blowing air and playing, as would a piston, within a subframe that is integral with the fixed machine framework, the metal plate playing with regard to the subframe when the rammer moves in an impervious position, the base frame capping the top of the moulding box also being coupled tightly to the subframe.

According to this structure, and after the first compacting stage comes about, by means of air released from the machine drum, the downward travel of the rammer shall cause the metal plate to act as a tamper to achieve the second operative stage, namely mechanical compacting, and thus, in addition to considerably improving overall compacting, the sand mass finally located at the frame level is very small, and so is the waste when the box is levelled.

BRIEF DESCRIPTION OF THE DRAWINGS

In order to provide a fuller description and contribute to the complete understanding of the characteristics of this invention.

DESCRIPTION OF THE PREFERRED EMBODIMENT OF THE INVENTION

Figure 1:
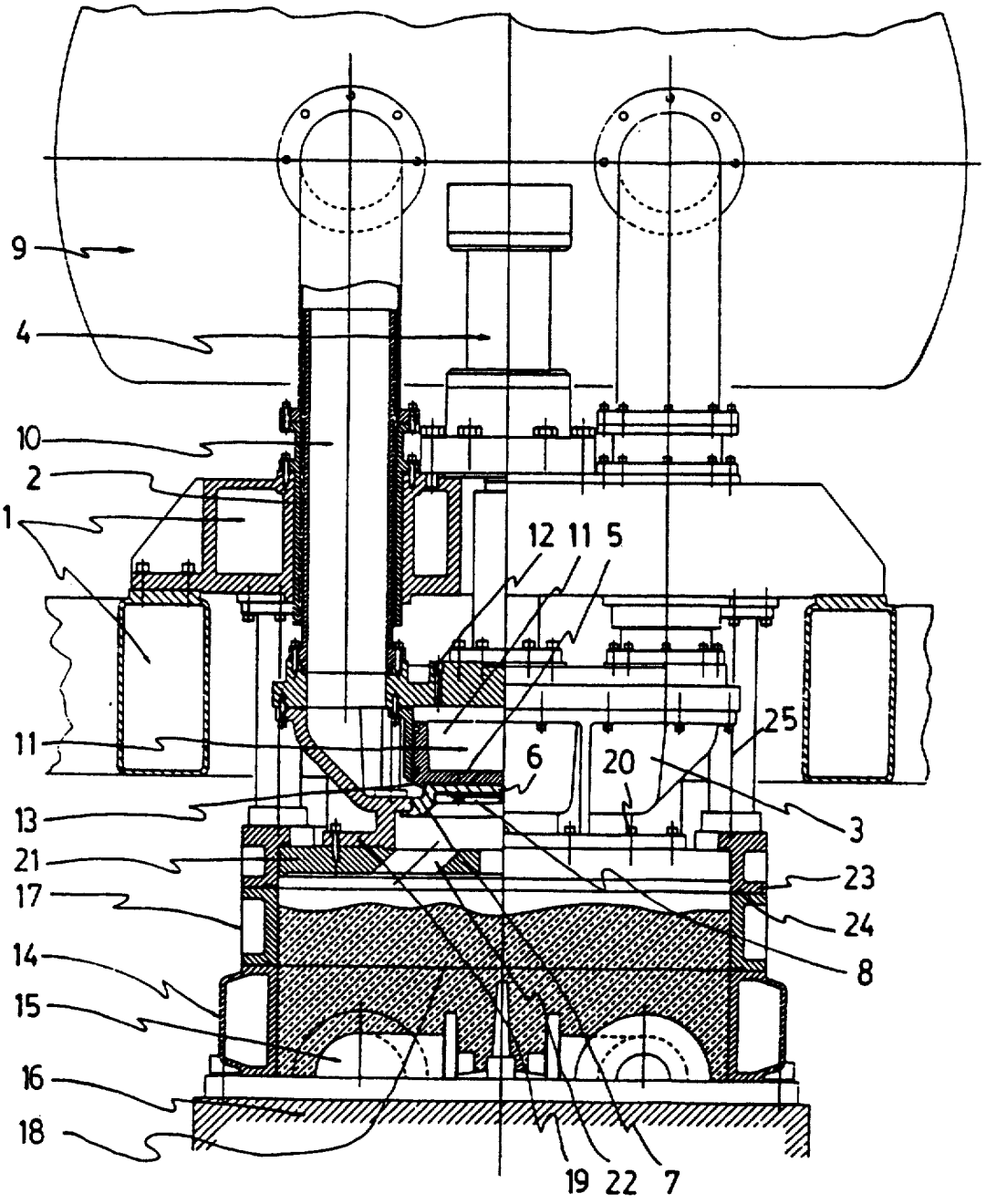
FIG. 1 is provided, showing a front elevation and a quarter cross-section of a blowing head for air impact sandbox moulding machines, accordance with the object of the present invention.
Figure 1:
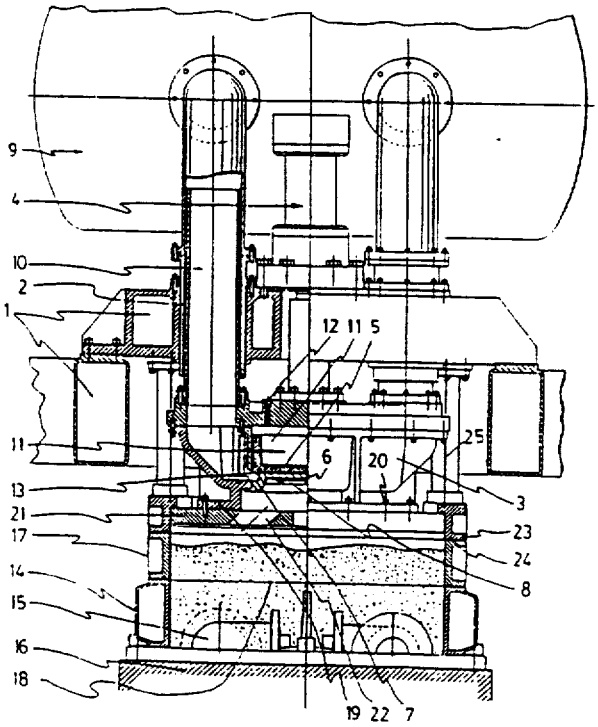

As can be seen from the drawing, the blowing head comprises a framework (1), duly associated to the general machine framework. The framework (1) carries guide-columns (2) that allow a hollow rammer or tamper (3) to travel vertically, driven by a hydraulic cylinder (4) and within which is provided the blowing valve, whose piston or stopper (5) overlies, with the assistance of a gasket (6), the relevant foundation (7), blocking the mouth (8) for outlet of the air from a drum (9), through conduits (10) that play within the actual guide-columns (2), with respect to which they are duly sealed. The stopper (5) is normally kept closed due to existence within the same of a chamber (11) that also receives drum pressure, specifically through an inlet (12), so that this pressure tends to hold the stopper, (5) closed, the same opening when the pressure fed into this auxiliary chamber (11) is discontinued, and by action also of the drum (9) pressure, acting permanently upon the perimetric flange (13) of the stopper (5), clearly visible in the figure.

The blowing head thus structured is designed to act, as in any moulding machine of this kind, upon a moulding box (14) that will laterally frame the moulding plate (15) that shall in turn rest upon the respective table (16), the top of the moulding box (14) being sealed with a frame (17) designed to receive an overdose of sand (18) that is deposited upon the box-frame assembly, so that after a subsequent levelling operation and after eliminating the frame (17), the box (14) will be full of sand.

In accordance with one of the essential characteristics of the invention, the lower end of the rammer (3) is provided, under the blowing hole (8), with a flange (19) by which the rammer is fitted, by means of screws (20), with a metal plate (21) carrying holes of suitable shape, size and position to aid the blowing of the sand mass (18) by action of the air mass coming from the drum (9) when the stopper (5) opens. The metal plate (21) plays within a subframe (23) capable of receiving and perfectly facing the frame (17), when the table (16) is lifted, and being perfectly sealed through a gasket (24), the subframe (23) being rigidly connected to the frame (1), specifically through columns (25), also of suitable number and distribution.

In accordance with the invention, when the inlet (12) to the auxiliary chamber (11) provided at the rear of the piston (5) of the blowing valve is blocked, the blowing head will cause a sudden release of air or will blow towards the box (14), when the valve opens, viz. when the piston (5) retracts, the air leaving through the mouth (8) and crossing the metal plate (21) through the holes (22), this causing a first compacting stage of the sand, whereupon the press cylinder (4) shall cause the rammer (3) to travel downwards, and to reach the metal plate (21), which acts as a piston inside the subframe (23), then reaching the frame (17) where it carries out the sand mass (18) in the second compacting stage, naturally in this case by mechanical compacting, making up a sort of tamper and obtaining, as above mentioned, the best possible compacting and wasting very little sand.

It is believed that the device has now been sufficiently described for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. An air impact sandbox moulding machine comprising a stationary framework; a liftable table; a moulding box and a frame connected thereto for containing sand mass, said table carrying a moulding plate to place said plate in contact with the sand mass contained within said moulding box and said frame; two vertical guide columns positioned in said frame-work; a subframe positioned adjacent said frame at an end face thereof and rigidly connected to said framework, said subframe being tightly coupled to said frame as said table carrying said moulding plate has been lifted; a metal plate positioned in said subframe with a play and having holes for passing therethrough of air to be blown into said moulding box; a movable rammer positioned within said framework; a cylinder also positioned at said framework and connected to said rammer for driving said rammer in an upward and downward direction; and a blowing head including a drum and air conduits connected thereto for supplying blown air through said conduits, said air conduits being telescopic and positioned within said vertical guide columns with a play, said rammer including a valve having a stopper movable therewith so as to open or close a mouth opening which is in communication with said air conduits for blowing air into said moulding box through said holes in said metal plate so as to compact the sand mass within said moulding box and said frame by air blowing, said rammer including a flange rigidly connected to said metal plate to move said metal plate along with said rammer downwards so as to place said metal plate in contact with the sand mass contained within said moulding box and said frame to mechanically compact the sand mass after said compacting by air blowing.

* * * * *

UNITED STATES PATENT AND TRADEMARK OFFICE

CERTIFICATE OF CORRECTION

PATENT NO. : 5,301,740

DATED : April 12, 1994

INVENTOR(S) : Augustin Arana Erana

It is certified that error appears in the above-identified patent and that said Letters Patent is hereby corrected as shown below:

The title page, should be deleted to be replaced with the attached title page.

The drawing sheet, consisting of Fig. 1, should be deleted to be replaced with the drawing sheet, consisting of Fig. 1, as shown on the attached page.

Signed and Sealed this

Thirtieth Day of August, 1994

*Attest:*

*Attesting Officer*

BRUCE LEHMAN

*Commissioner of Patents and Trademarks*

United States Patent [19]

Erana

[11] Patent Number: 5,301,740

[45] Date of Patent: Apr. 12, 1994

[54] AIR IMPACT SANDBOX MOULDING MACHINE WITH A BLOWING HEAD

[76] Inventor: Augustin A. Erana, Zorrostea 4, Poligano Industrial Ali Gobeo, 01010- Vitoria (Alava), Spain

[21] Appl. No.: 967,698

[22] Filed: Oct. 27, 1992

[30] Foreign Application Priority Data

Oct. 30, 1991 [ES] Spain ..... 9102403

[51] Int. Cl.[5] ..... B22C 15/28

[52] U.S. Cl. ..... 164/195; 164/169; 164/207

[58] Field of Search ..... 164/195, 169, 207, 37, 164/38

[56] References Cited

U.S. PATENT DOCUMENTS 4,230,172 10/1980 Uzaki et al. ..... 164/195 X
4,750,540 6/1988 Boenisch ..... 164/195 X
5,161,596 11/1992 Fischer et al. ..... 164/195 X

*Primary Examiner*—J. Reed Batten, Jr.
*Attorney, Agent, or Firm*—Helfgott & Karas

[57] ABSTRACT

A moulding machine with a blowing head includes a hollow rammer within which is provided a valve which receives blast air from a drum and which by telescopic conduits plays inside guide-columns in a fixed framework. The rammer is fixed through a flange to a metal plate provided with holes for passage therethrough of blowing air. The metal plate plays tightly inside a subframe which is rigidly connected to a framework fixed to the machine. Another frame, associated with a moulding box, is tightly coupled with the box when a table carrying a moulding plate rises so that after blowing air when the valve opens or after compacting by blowing, the rammer travels down and hence also the metal plate which performs a mechanical compacting of the sand mass.

1 Claim, 1 Drawing Sheet

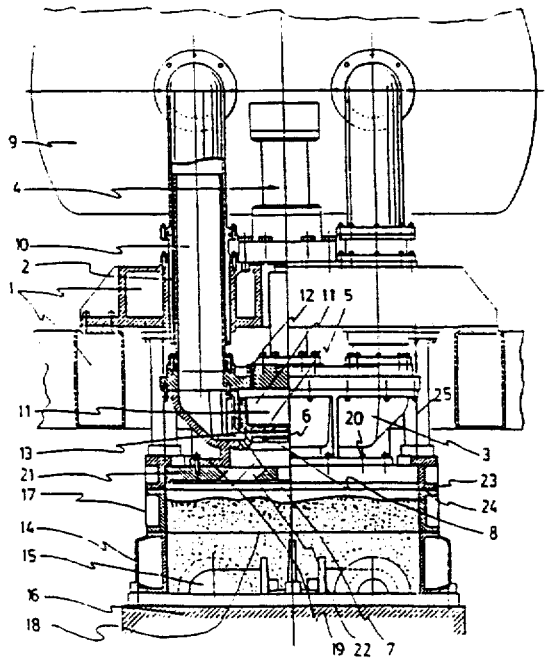

UNITED STATES PATENT AND TRADEMARK OFFICE

CERTIFICATE OF CORRECTION

PATENT NO. : 5,301,740

DATED : April 12, 1994

INVENTOR(S) : Agustin Arana Erana

It is certified that error appears in the above-identified patent and that said Letters Patent is hereby corrected as shown below:

On the title page, item [76] Inventors: should read

--Agustin A. Erana, Zorrostea 4, Poligono Industrial Ali Gobeo, 01010-Vitoria (Alava), Spain.--

Signed and Sealed this

Twenty-first Day of February, 1995

*Attest:*

Bruce Lehman

BRUCE LEHMAN

*Attesting Officer*

*Commissioner of Patents and Trademarks*